US011131042B1

(12) United States Patent
Kim

(10) Patent No.: US 11,131,042 B1
(45) Date of Patent: Sep. 28, 2021

(54) HIGH TENACITY YARN AND METHOD OF MANUFACTURING GLOVE USING SAME

(71) Applicant: Yong Gun Kim, Seongnam-si (KR)

(72) Inventor: Yong Gun Kim, Seongnam-si (KR)

( * ) Notice: Subject to any disclaimer, the term of this patent is extended or adjusted under 35 U.S.C. 154(b) by 0 days.

(21) Appl. No.: 17/198,859

(22) Filed: Mar. 11, 2021

(30) Foreign Application Priority Data

Dec. 16, 2020 (KR) ..... 10-2020-0176555

(51) Int. Cl.
*D02G 3/38* (2006.01)
*D02G 3/12* (2006.01)
*D02G 3/44* (2006.01)
*D04B 1/28* (2006.01)

(52) U.S. Cl.
CPC ..... *D02G 3/38* (2013.01); *D02G 3/12* (2013.01); *D02G 3/442* (2013.01); *D04B 1/28* (2013.01)

(58) Field of Classification Search
CPC .. D02G 3/04; D02G 3/12; D02G 3/36; D02G 3/38; D02G 3/442; D04B 1/28
See application file for complete search history.

(56) References Cited

U.S. PATENT DOCUMENTS 4,384,449 A * 5/1983 Byrnes, Sr. ..... A41D 19/01511 139/425 R
4,470,251 A * 9/1984 Bettcher ..... A41D 19/01511 57/230
4,967,548 A * 11/1990 Fangeat ..... D02G 3/443 57/224
5,287,690 A * 2/1994 Toon ..... A41D 19/01511 57/210
5,423,168 A * 6/1995 Kolmes ..... D02G 3/12 57/229
5,597,649 A * 1/1997 Sandor ..... D01F 1/10 428/370
5,738,940 A * 4/1998 Neuert ..... D01F 1/10 428/372
6,260,344 B1 * 7/2001 Chakravarti ..... D02G 3/12 57/230
6,279,305 B1 * 8/2001 Hummel ..... A41D 19/01511 57/210
6,581,366 B1 * 6/2003 Andrews ..... D02G 3/328 57/225

(Continued)

FOREIGN PATENT DOCUMENTS

JP 2012-21258 A 2/2012
JP 2012-158848 A 8/2012

(Continued)

*Primary Examiner* — Shaun R Hurley
(74) *Attorney, Agent, or Firm* — Saliwanchik, Lloyd & Eisenschenk

(57) ABSTRACT

Proposed are a high tenacity yarn and a method of manufacturing a glove using the same. More particularly, proposed are a high tenacity yarn capable of being knitted finely and thinly and having a high tenacity even if a metallic yarn is used as a core of a main yarn, and a method of manufacturing a glove using the same. To this end, the high tenacity yarn includes a core yarn and a covering yarn wound on a circumference of the core yarn. The core yarn includes a first core yarn part formed of a metal component and a second core yarn part formed of a metal component, and a total thickness of the first core yarn part and the second core yarn part is formed to be 0.07 mm or less.

7 Claims, 6 Drawing Sheets

(56) References Cited

U.S. PATENT DOCUMENTS

| | | | | |
|---|---|---|---|---|
| 7,762,053 | B2 * | 7/2010 | Takada | A41D 19/01511 57/230 |
| 2003/0074879 | A1 * | 4/2003 | Patrick | D02G 3/442 57/229 |
| 2005/0086924 | A1 * | 4/2005 | Kolmes | D02G 3/12 57/229 |
| 2007/0062173 | A1 * | 3/2007 | Hummel | A41D 31/24 57/210 |
| 2010/0236294 | A1 * | 9/2010 | Dias | D04B 1/14 66/174 |
| 2012/0263952 | A1 * | 10/2012 | Kim | D06B 3/045 428/400 |
| 2015/0220146 | A1 * | 8/2015 | Fisher | G06F 3/014 2/167 |
| 2017/0350044 | A1 * | 12/2017 | Sugita | D04B 1/28 |
| 2018/0087191 | A1 * | 3/2018 | Threlkeld | D02G 3/441 |
| 2019/0055676 | A1 * | 2/2019 | Chen | A41D 19/01511 |
| 2021/0071323 | A1 * | 3/2021 | Hu | D02G 3/047 |

FOREIGN PATENT DOCUMENTS

| | | | | |
|---|---|---|---|---|
| JP | 2016-60970 | A | 4/2016 | |
| JP | 2018080413 | A * | 5/2018 | D02G 3/12 |
| JP | 2019-131900 | A | 8/2019 | |
| KR | 20-0393646 | Y1 | 8/2005 | |
| KR | 10-1890566 | B1 | 8/2018 | |
| KR | 10-2020-0106715 | A | 9/2020 | |
| KR | 10-2208801 | B1 | 1/2021 | |

* cited by examiner

HIGH TENACITY YARN AND METHOD OF MANUFACTURING GLOVE USING SAME

CROSS REFERENCE TO RELATED APPLICATION

The present application claims priority to Korean Patent Application No. 10-2020-0176555, filed Dec. 16, 2020, the entire contents of which is incorporated herein for all purposes by this reference.

BACKGROUND OF THE INVENTION

Field of the Invention

The present disclosure relates to a high tenacity yarn and a method of manufacturing a glove using the same and, more particularly, to a high tenacity yarn capable of being knitted finely and thinly and having a high tenacity, and a method of manufacturing a glove using the same.

Description of the Related Art

In general, a coated glove denotes a glove which is formed by coating a surface of a knitted glove knitted with a nylon yarn, a spandex yarn, a cotton yarn, a polyester yarn, a glass fiber, or the like to impart abrasion resistance, tear strength, puncture resistance, slip resistance, air permeability, a waterproof function, and the like.

In addition, in industrial fields requiring special safety, protective gear such as gloves and helmets are used to protect workers. Among this protective gear, gloves have recently been made using a material such as a High-Performance Polyethylene (HPPE) fiber and the like which has a sufficient tenacity to protect worker's hand.

At this time, a yarn made of the HPPE fiber described herein has a thickness of about 200 to 400 denier to secure processability and a suitable tenacity. However, a price of the HPPE fiber is higher than that of a nylon fiber or polyester fiber, thereby resulting in an increase in manufacturing costs in mass production.

On the other hand, the nylon fiber or the polyester fiber is cheaper than the HPPE fiber and is capable of being made of a product having a thickness thinner than that of the HPPE fiber, but a tenacity thereof is weak, so that the nylon fiber or the polyester fiber is not currently used as a core yarn for manufacturing a high tenacity glove.

In addition, there is a problem in that it is difficult to knit a glove and the like by using a yarn in which a glass fiber is used as a core yarn. This is because the yarn in which the glass fiber is used as a core yarn is fragile and a powder is discharged when it is broken.

Accordingly, a technology of manufacturing a glove by using a single metallic yarn such as a stainless steel yarn or a tungsten yarn as a core of a main yarn has been introduced. However, according to the above conventional technology that has uses a metallic yarn as a core of a main yarn, the HPPE fiber is used together as a core of the main yarn. This is because it is difficult to keep the metallic yarn from breaking during a manufacturing process. In addition, a thickness of the core has to be thickened to secure a sufficient tenacity, so that it is not possible to use an 18-gauge knitting machine. Therefore, there is a problem in that it is not possible to knit a glove having a finer structure.

DOCUMENT OF RELATED ART (Patent Document 1) Korean Patent No. 10-1890566 'Glove and glove manufacturing method using tungsten yarn'

(Utility Model Document 1) Korean Utility Model No. 20-0393646 'Covering yarn of two-layer using stainless wire'

SUMMARY OF THE INVENTION

Accordingly, the present disclosure has been made keeping in mind the above problems occurring in the related art, and the present disclosure is intended to propose a high tenacity yarn capable of being knitted finely and thinly and having a high tenacity even if a metallic yarn is used as a core of a main yarn, and a method of manufacturing a glove using the same.

In order to achieve the above objective, the high tenacity yarn of the present disclosure includes a core yarn and a covering yarn wound on a circumference of the core yarn. The core yarn includes a first core yarn part formed of a metal component and a second core yarn part formed of a metal component, and the total thickness of the first core yarn part and the second core yarn part is formed to be 0.07 mm or less.

In addition, the first core yarn part may be a stainless steel yarn having a predetermined thickness, and the second core yarn part may be a tungsten yarn having a thickness thinner than the first core yarn part.

In addition, the covering yarn may include a first covering yarn part formed of a poly yarn or a nylon yarn having a thickness of 70 to 80 denier and wound in a clockwise or counterclockwise direction on the core yarn, and a second covering yarn part formed of a nylon yarn having a thickness of 190 to 220 denier and wound on an outer side of the first covering yarn part in a direction opposite to a wound direction of the first covering yarn part.

In addition, the first covering yarn part may be wound with 2000 to 2200 Twists Per Meter (TPM), and the second covering yarn part may be wound with 190 to 220 TPM.

In addition, the second covering yarn part may be treated to be softened.

In addition, the second covering yarn part may be heat-treated by passing through a heater that has a ring shape and is configured to radiate heat of 150 to 200° C., and then the second covering yarn part passes through a scratcher that has a ring shape and has scratching protrusions formed along an inner circumference of the scratcher, so scratches are formed on an outer circumferential surface of the second covering yarn part, and thus the second covering yarn part may be softened.

In addition, a plurality of scratchers may be provided, and the plurality of scratchers may be arranged to be spaced apart from each other in a front-rear direction and have different heights and positions in a left-right direction, so that a Venn diagram structure when viewed from the front direction may be formed, and the second covering yarn part may pass through an intersection point when viewed from the front direction of the plurality of scratchers, and the scratches may be formed on different positions of the outer circumferential surface of the second covering yarn part by each of the scratchers.

In the meanwhile, in order to achieve the above objective, in the method of manufacturing a glove using the high tenacity yarn of the present disclosure, the glove is manufactured by double-knitting the high tenacity yarn as a main yarn together with auxiliary yarns by using a knitting machine. In a hand part of the glove, an auxiliary yarn used in knitting the hand part includes an auxiliary core yarn formed of a spandex yarn, and an auxiliary covering yarn wound on the auxiliary core yarn and formed of the nylon yarn. In a wrist part of the glove, an auxiliary yarn used in knitting the wrist part is formed of a rubber material or a spandex material.

In addition, each of the auxiliary core yarn and the auxiliary covering yarn may have a thickness of 65 to 75 denier, and the auxiliary covering yarn may be wound on the auxiliary core yarn with 350 to 450 TPM.

In addition, the knitting machine may be an 18-gauge knitting machine.

According to the present disclosure, by forming the total thickness of the first core yarn part and the second core yarn part, which are formed of a metal component and used as a core of the high tenacity yarn, to be 0.07 mm or less, it is possible to use an 18-gauge knitting machine even if the core of the main yarn is a metallic yarn, so that a glove having a fine, thin, and high tenacity may be manufactured by using the high tenacity yarn. In addition, when the first core yarn part and the second core yarn part are formed of different kinds of metal components, a synergistic effect is created, so that a sufficient tenacity and a flexible capacity may be realized.

BRIEF DESCRIPTION OF THE DRAWINGS

The above and other objectives, features, and other advantages of the present disclosure will be more clearly understood from the following detailed description when taken in conjunction with the accompanying drawings, in which.

DESCRIPTION OF THE PREFERRED EMBODIMENTS

In the present disclosure, there is proposed a high tenacity yarn that is capable of being knitted finely and thinly even if a metallic yarn is used as a core of a main yarn. To this end, the high tenacity yarn includes a core yarn and a covering yarn wound on a circumference of the core yarn. The core yarn includes a first core yarn part formed of a metal component and a second core yarn part formed of a metal component, and a total thickness of the first core yarn part and the second core yarn part is formed to be 0.07 mm or less.

In addition, a method of manufacturing a glove by using the high tenacity yarn is proposed. The glove is manufactured by double-knitting of the high tenacity yarn as a main yarn together with auxiliary yarns by using a knitting machine. In a hand part of the glove, an auxiliary yarn used in knitting the hand part includes an auxiliary core yarn formed of a spandex yarn, and an auxiliary covering yarn wound on the auxiliary core yarn and formed of the nylon yarn. In a wrist part of the glove, an auxiliary yarn used in knitting the wrist part is formed of a rubber material or a spandex material.

The scope of the rights of the present disclosure is not limited to the following embodiments, but it will be apparent to those skilled in the art that the present disclosure may be modified and practiced in various ways within a range that does not depart from the technical spirit of the present disclosure.

Hereinafter, a high tenacity yarn and a method of manufacturing a glove using the same according to the present disclosure will be described in detail with reference to FIGS. 1 to 7.

The high tenacity yarn of the present disclosure includes a core yarn 10 and a covering yarn 20 wound around the core yarn 10.

Figure 1:
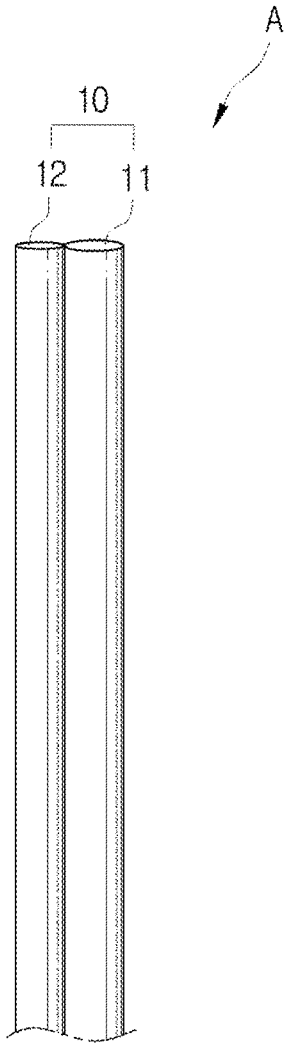
FIG. 1 is a view illustrating a core yarn applied to a high tenacity yarn of the present disclosure.
Figure 2:
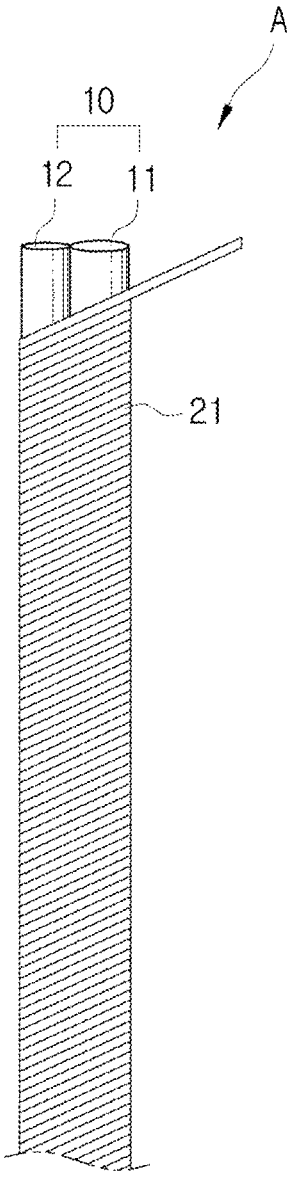
FIG. 2 is a view illustrating a wound structure of a first covering yarn part that is wound around the core yarn applied to the high tenacity yarn of the present disclosure.
Figure 3:
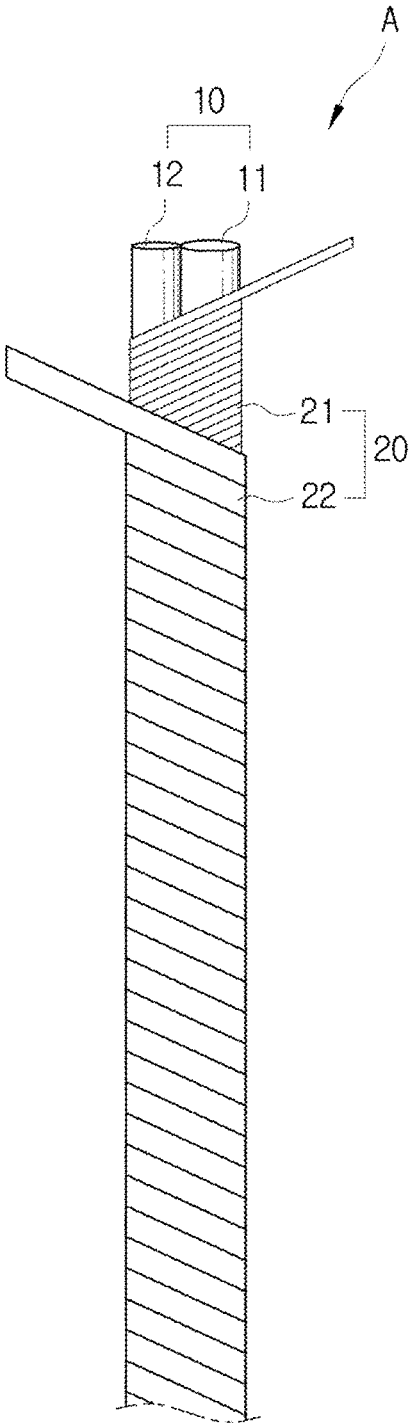
FIG. 3 is a view illustrating a structure of the high tenacity yarn of the present disclosure.

As illustrated in FIGS. 1 to 3, the core yarn 10 includes a first core yarn part 11 and a second core yarn part 12, and the first core yarn part 11 and the second core yarn part 12 are both formed of a metal component. For example, the first core yarn part 11 or/and the second core yarn part 12 may be a stainless steel yarn, a tungsten yarn, and so on. In other words, the first core yarn part 11 and the second core yarn part 12 may be formed of the same kind of metal component, or the first core yarn part 11 and the second core yarn part 12 may be formed of a different kind of metal component.

However, to have a synergistic effect with each other, the first core yarn part 11 and the second core yarn part 12 may be formed of a different kind of metal component. For example, the first core yarn part 11 may be formed of the stainless steel yarn, and the second core yarn part 12 may be formed of the tungsten yarn. Compared to the stainless steel yarn, the tungsten yarn has higher tenacity, but has lower ductility, while the stainless steel yarn has lower tenacity, but has higher ductility. In other words, when the core yarn 10 is formed of both the first core yarn part 11 formed of the stainless steel yarn and the second core yarn part 12 formed of the tungsten yarn, the synergistic effect with each other occurs, so that the core yarn 10 with sufficient tenacity and ductility may be formed.

In addition, the total thickness of the first core yarn part 11 and the second core yarn part 12 is formed to be 0.07 mm or less. Even when the total thickness of the first core yarn part 11 and the second core yarn part 12 exceeds 0.07 mm, it is possible to form a high tenacity yarn by winding the covering yarn 20 thereto. However, it is not possible to use an 18-gauge knitting machine for knitting a glove thinly and there is a high risk of a yarn breakage due to insufficient ductility, so that the total thickness of the first core yarn part 11 and the second core yarn part 12 is formed to be 0.07 mm or less.

For example, a thickness of the first core yarn part 11 formed of the stainless steel yarn may be 0.035 mm, and a thickness of the second core yarn part 12 formed of the tungsten yarn may be 0.03 mm. This is a consideration of a specific gravity of metal components forming the first core yarn part 11 and the second core yarn part 12. Accordingly, the second core yarn part 12 is formed of a metal component having a higher specific gravity, so that the second core yarn part 12 is thinner than the first core yarn part 11 formed of a metal component having a relatively low specific gravity.

The first core yarn part 11 and the second core yarn part 12 are arranged adjacent to each other in a row, thus forming the core yarn 10.

As illustrated in FIGS. 2 and 3, the covering yarn 20 may include a first covering yarn part 21 wound in a clockwise or counterclockwise direction on the core yarn 10, and a second covering yarn part 22 wound on an outer side of the first covering yarn part 21 in a direction opposite to a wound direction of the first covering yarn part 21.

As illustrated in FIG. 2, the first covering yarn part 21 may be wound in the clockwise or counterclockwise direction so as to cover both the first core yarn part 11 and the second core yarn part 12 arranged with each other in a row together, and may form a primary yarn that is together with the first core yarn part 11 and the second core yarn part 12. At this time, the first covering yarn part 21 may be formed of a poly yarn or a nylon yarn having a thickness of 70 to 80 denier, and may be wound with 2000 to 2200 Twists Per Meter (TPM). For example, the poly yarn forming the first covering yarn part 21 may be a polyester yarn or a polypropylene yarn. In addition, when the first covering yarn part 21 formed of the poly yarn or the nylon yarn is wound with less than 2000 TPM, the core yarn 10 may be exposed, and when the first covering yarn part 21 is wound with more than 2200 TPM, the primary yarn may become hard and productivity may decrease.

As illustrated in FIG. 3, the second core yarn part 22 covers the primary yarn that is formed of the first core yarn part 11, the second core yarn part 12, and the first covering yarn part 21, so that the high tenacity yarn is formed by covering the second core yarn part 22 on an outer side of the first covering yarn part 21 in a direction opposite to a wound direction of the first covering yarn part 21. At this time, the second covering yarn part 22 may be formed of a nylon yarn or a polyester yarn having a thickness of 190 to 220 denier, and may be wound with 190 to 220 TPM. When the second covering yarn part 22 formed of the nylon yarn is wound with less than 190 TPM, the yield may be decreased by a defect during knitting, and when wound with more than 220 TPM, the softness of the manufactured glove may be decreased.

In addition, the second covering yarn part 22 has been treated to be softened in advance, so that the second covering yarn part 22 may be softer and more flexible than a second covering yarn part that has not been treated to be softened. Accordingly, the second covering yarn part 22 having a thickness thinner than that of the second covering yarn part 22 conventionally wound around the primary yarn may be used.

Figure 4:
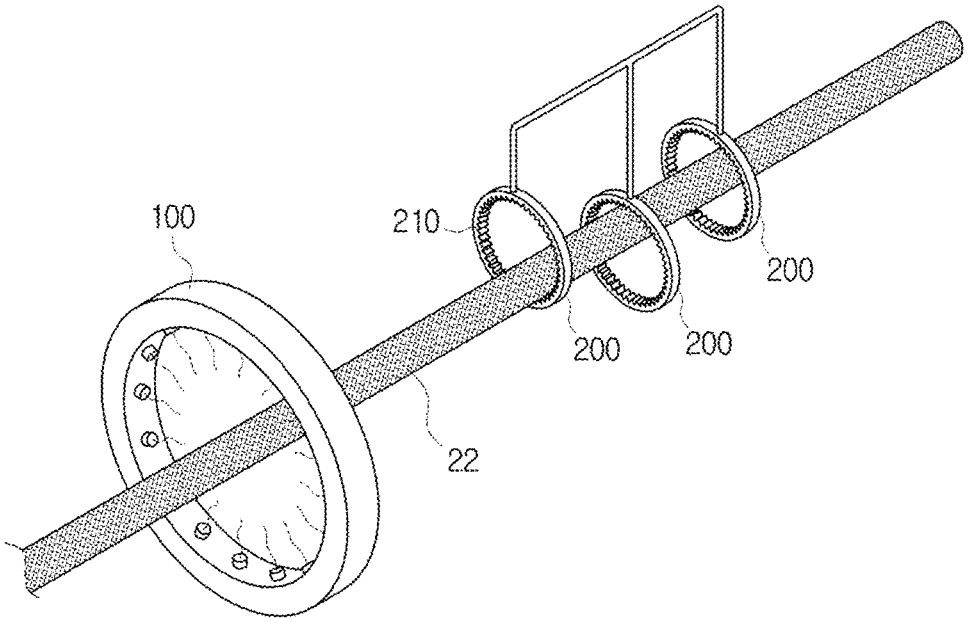
FIG. 4 is a view illustrating a softening treatment process of a second covering yarn part applied to the high tenacity yarn of the present disclosure.

As an example for the softening treatment of the second covering yarn part 22, a heater 100 and a scratcher 200 may be used. As illustrated in FIG. 4, the heater 100 may have a ring shape and may be configured to radiate heat of 150 to 200° C., and the scratcher 200 may have a ring shape, and scratching protrusions may be formed along an inner circumference of the scratcher 200. Therefore, the second covering yarn part 22 is heat-treated by passing through an inside of the heater 100 and then treated to be softened by passing through an inside of the scratcher 200 that is configured to form scratches on an outer circumferential surface of the second covering yarn part 22 by being in contact with the second covering yarn part 22 with the scratching protrusions 210.

At this time, it is difficult to manufacture the scratcher 200 which is scratching the entire outer circumferential surface of the second covering yarn part 22 with a single scratcher 200, and scratches may be formed only partially due to a shaking of the second covering yarn part 22 passing through the scratcher 200, so that using a plurality of scratchers 200 is preferable to form the scratches.

Figure 5:
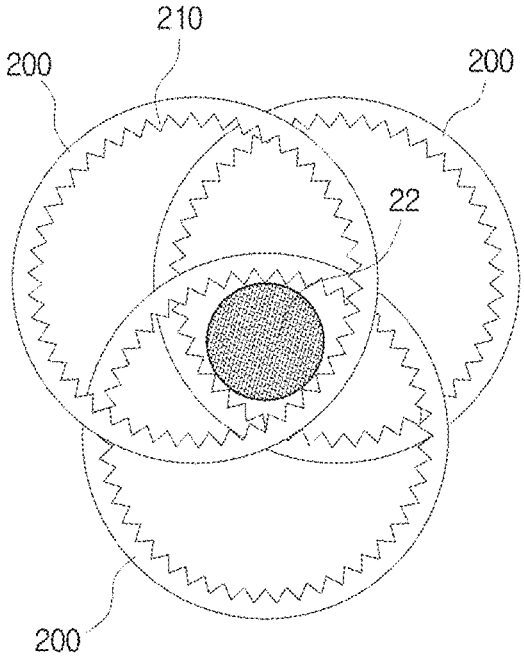
FIG. 5 is a view illustrating an arrangement structure of scratchers used in the softening treatment of the second covering yarn part applied to the high tenacity yarn of the present disclosure.

For example, as illustrated in FIGS. 4 and 5, the plurality of scratchers 200 are arranged to be spaced apart from each other in a front-rear direction and have different heights and positions in a left-right direction, so that a Venn diagram structure when viewed from the front direction may be formed. When considering that the cross-section of the second covering yarn part 22 is a circular shape, it is preferable to arrange at least three scratchers 200 so as to form the Venn diagram structure when viewed from the front direction. The second covering yarn part 22 passes through a space within an intersection point when viewed from the front direction of the plurality of scratchers 200, and the scratches are formed on different portions of the outer circumferential surface of the second covering yarn part 22 by each of the scratchers 200. In other words, a portion of each scratcher 200 forms scratches on a portion of the outer circumferential surface of the second covering yarn part 22, and the scratches are formed across the outer circumferential surface of the second covering yarn part 22 which is passing through the plurality of scratchers 200.

By using the second covering yarn part 22 that is treated to be softened via the heating treatment and the scratching treatment as described above, the high tenacity yarn may be formed with a thinner covering yarn 20 compared to a covering yarn used to be wound to form a conventional high tenacity yarn, so that using the 18-gauge knitting machine is possible even if the core yarn of the main yarn is a metallic yarn.

On the other hand, when looking at the method of manufacturing a glove by using the above described high tenacity yarn, the glove C is manufactured by double-knitting of a main yarn A together with auxiliary yarns B and D by using a knitting machine. The main yarn A is the high tenacity yarn which the covering yarn 20 is wound along the circumference of the core yarn 10 that is including the first core yarn part 11 and the second core yarn part 12 which are formed of a metal component. At this time, since the main yarn A is the high tenacity yarn having a thin thickness, the knitting machine that is used may be the 18-gauge knitting machine.

The glove C is formed of a hand part C1 covering a hand of a user and a wrist part C2 covering a wrist of the user, and both the hand part C1 and the wrist part C2 are formed to have elasticity. However, it is necessary to vary the elasticity imparted to each of the hand part C1 and the wrist part C2. Accordingly, differentiating the auxiliary yarn B used in knitting the hand part C1 and the auxiliary yarn D used in knitting the wrist part C2 is preferable.

Figure 6:
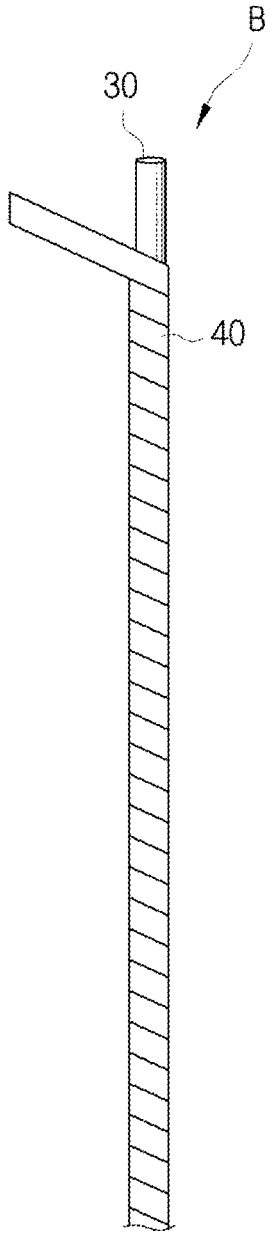
FIG. 6 is a view illustrating a structure of an auxiliary yarn B used in manufacturing a glove by using the high tenacity yarn of the present disclosure.

For example, as illustrated in FIG. 6, the auxiliary yarn B used in knitting the hand part C1 may include an auxiliary core yarn 30 formed of a spandex yarn and an auxiliary covering yarn 40 that is wound along the circumference of the auxiliary core yarn 30 and formed of a nylon yarn or a polyester yarn. Specifically, each of the auxiliary core yarn 30 and the auxiliary covering yarn 40 may have a thickness of 65 to 75 denier, and may be formed to have the same or different thickness. In addition, the auxiliary covering yarn 40 may be wound with 350 to 450 TPM on the auxiliary core yarn 30.

Moreover, a material of the auxiliary yarn D used in the knitting of the wrist part C2 is a rubber material. For example, the material of the auxiliary yarn D may be latex (rubber), polyurethane (spandex), and so on.

Figure 7:
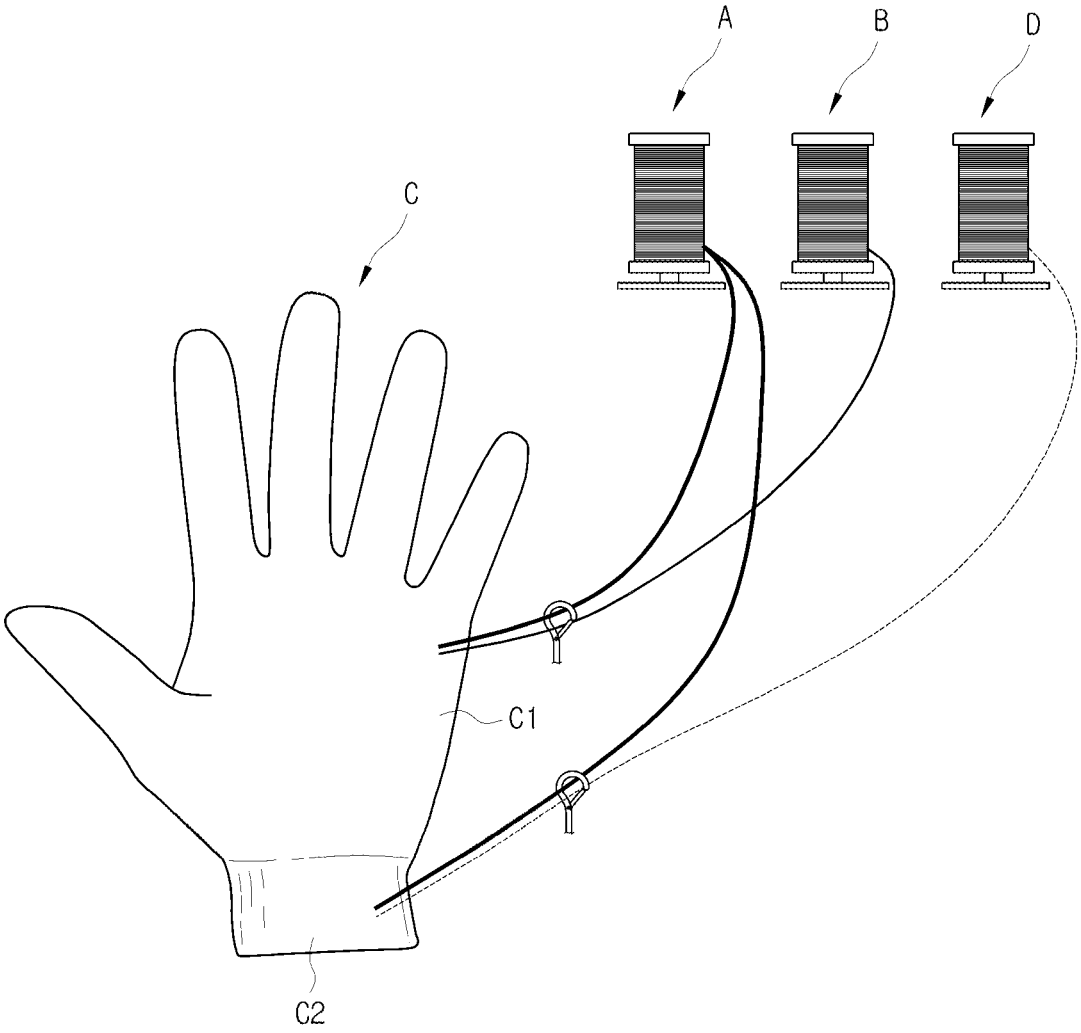
FIG. 7 is a view illustrating a main yarn and auxiliary yarns used in knitting a hand part and a wrist part when the glove is manufactured by using the high tenacity yarn of the present disclosure.

Therefore, as illustrated in FIG. 7, the hand part C1 is double-knitted by positioning the main yarn A as well as the auxiliary yarn B in which the nylon yarn is wound around the spandex yarn into a needle of the knitting machine, and the wrist part C2 is double-knitted by positioning the main yarn A as well as the auxiliary yarn D which is formed of the rubber material into the needle of the knitting machine. When the wrist part C2 is knitted, by deselecting the auxiliary yarn B and selecting the auxiliary yarn D so as to form the wrist part C2 having a tightened shape with respect to the hand part C1, and thus having more elasticity than the hand part C1 and inhibiting the main yarn A from being damaged may be realized. Accordingly, the glove manufactured by using the high tenacity yarn of the present disclosure may be knitted by the 18-gauge knitting machine with using two metallic yarns as a core, so that a glove having a fineness, thinness, and high tenacity may be realized.

What is claimed is:

1. A high tenacity yarn, the yarn comprising:

a core yarn; and a covering yarn wound on a circumference of the core yarn;

wherein the core yarn comprises:

a first core yarn part formed of a metal component; and a second core yarn part formed of a tungsten component, wherein a total thickness of the first core yarn part and the second core yarn part is formed to be 0.07 mm or less, and the covering yarn comprises:

a first covering yarn part formed of polyester, polypropylene, or a nylon yarn having a thickness of 70 to 80 denier and wound on the core yarn in a clockwise or a counterclockwise direction; and a second covering yarn part formed of a nylon yarn having a thickness of 190 to 220 denier and wound on an outer side of the first covering yarn part in a direction opposite to a wound direction of the first covering yarn part, wherein the second covering yarn part is treated to be softened;

wherein the first covering yarn part is wound with 2000 to 2200 Twists Per Meter (TPM), and the second covering yarn part is wound with 190 to 220 TPM.

2. The yarn of claim 1, wherein the first core yarn part is a stainless steel yarn having a predetermined thickness, and the second core yarn part is a tungsten yarn having a thickness thinner than the first core yarn part.

3. The yarn of claim 1, wherein the second covering yarn part is heat-treated by passing through a heater that has a ring shape and is configured to radiate heat of 150 to 200° C., and then the second covering yarn part passes through a scratcher that has a ring shape and has scratching protrusions formed along an inner circumference of the scratcher, so scratches are formed on an outer circumferential surface of the second covering yarn part, and thus the second covering yarn part is softened.

4. The yarn of claim 3, wherein a plurality of scratchers is provided, and the plurality of scratchers is arranged to be spaced apart from each other in a front-rear direction and has different heights and positions in a left-right direction, so that a Venn diagram structure when viewed from a front direction is formed, and wherein the second covering yarn part passes through a space within an intersection point when viewed from the front direction of the plurality of scratchers, and the scratchers are formed on different positions of the outer circumferential surface of the second covering yarn part by each of the scratchers.

5. A method of manufacturing a glove using the high tenacity yarn of any one of claims 1, 2, 3 and 4, wherein the glove is manufactured by double-knitting of the high tenacity yarn as a main yarn together with auxiliary yarns by using a knitting machine, wherein an auxiliary yarn used in knitting a hand part of the glove that covers a hand of a user comprises:

an auxiliary core yarn formed of a spandex yarn; and an auxiliary covering yarn formed of a nylon yarn and wound on the auxiliary core yarn, and an auxiliary yarn used in knitting a wrist part of the glove that covers a wrist of the user is formed of a rubber material or a spandex material.

6. The method of claim 5, wherein each of the auxiliary core yarn and the auxiliary covering yarn has a thickness of 65 to 75 denier, and the auxiliary covering yarn is wound on the auxiliary core yarn with 350 to 450 TPM.

7. The method of claim 6, wherein the knitting machine is an 18-gauge knitting machine.

* * * * *